United States Patent [19]

Boozer

[11] 4,406,933

[45] Sep. 27, 1983

[54] NEUTRAL POSITION LIMIT SWITCH LEVER HEAD

[75] Inventor: J. Michael Boozer, Asheville, N.C.

[73] Assignee: Square D Company, Palatine, Ill.

[21] Appl. No.: 347,852

[22] Filed: Feb. 11, 1982

[51] Int. Cl.[3] ..... H01H 3/16

[52] U.S. Cl. ..... 200/47; 200/153 LB; 200/336; 74/99 R

[58] Field of Search ..... 200/47, 153 LB, 153 N, 200/336; 74/99 R, 53

[56] References Cited

U.S. PATENT DOCUMENTS

| | | | |
|---|---|---|---|
| 2,964,602 | 12/1960 | Watson | 200/68 X |
| 3,275,764 | 9/1966 | Kiessling et al. | 200/47 |
| 3,370,138 | 2/1968 | Vinot | 200/47 |
| 3,539,738 | 11/1970 | Bowen et al. | 200/47 |
| 3,712,965 | 1/1973 | Dalton | 200/47 X |
| 3,829,637 | 8/1974 | Kilcoin | 200/47 |

FOREIGN PATENT DOCUMENTS

| | | | |
|---|---|---|---|
| 17169 | 7/1913 | France | 74/53 |

*Primary Examiner*—John W. Shepperd
*Assistant Examiner*—Renee S. Kidorf
*Attorney, Agent, or Firm*—W. H. Schmeling

[57] ABSTRACT

This disclosure depicts a novel apparatus for use with an electric limit switch. The apparatus is a neutral position limit switch lever head, or multiple position off-center to center movement translator, for use with an operator having first and second movable elements and a receiver having a movable member. The apparatus comprises a support cover, a linear actuator in contact with the movable member of the receiver and a tri-lobe roller follower in contact with the linear actuator and the two movable elements of the operator. The support cover retains the linear actuator in the center of the support cover and also holds the tri-lobe roller follower in position. The novel apparatus converts the off-center movement of the movable elements of the operator to a linear center movement of the linear actuator.

12 Claims, 16 Drawing Figures

NEUTRAL POSITION LIMIT SWITCH LEVER HEAD

BACKGROUND OF THE INVENTION AND PRIOR ART STATEMENT

The present invention relates to electric switches and, more particularly, to an electric limit switch type device. A large number of different types of limit switches exist in the prior art.

U.S. Pat. No. 3,275,764 issued to Kiessling, et al, discloses an electric limit switch having basically two sections. A snap switch section and a lever head section, as shown in FIG. 2 of the patent. The lever head section, or external operating mechanism, has a shaft with two cams mounted on the shaft. When the shaft is turned in either direction, the cams operate a pair of pins which cause the snap switch to operate. The two plungers shown in FIG. 2 cause the snap switch to operate when the cams in the lever head push on the plungers. The lever head may be attached to the snap switch in any one of four directions, provided the plungers are rearranged properly. It is desirable to have a mechanism which translates the movement of the shaft in the lever head to a linear movement of a member which is centrally located with regard to the lever head for operation of the snap switch by a single plunger. It was found that no such device existed in the prior art, and the present invention solves this problem.

The relevance of the prior art indicated in the present specification should not be given a limited interpretation. A cited prior art item may be found to have relevance in a passage other than the one referred to, or to have relevance in a sense different then as stated.

OBJECTS OF THE INVENTION

It is a general object of the present invention to provide a multiple position off-center to center movement translator for use with an electric limit switch.

It is a more specific object of the present invention to provide a novel neutral position limit switch which is inexpensive to manufacture.

It is another object of the present invention to provide a mechanism for use with an electric limit switch Which is simple in construction and reliable in operation.

BRIEF DESCRIPTION OF THE DRAWINGS

The features of the present invention which are believed to be novel are set forth with particularity in the appended claims. The invention, together with further objects and advantages, may best be understood by reference to the following description taken in conjunction with the accompanying drawings, in the several figures of which like reference numerals identify like elements, and in which:

DESCRIPTION OF THE PREFERRED EMBODIMENT

Figure 1:
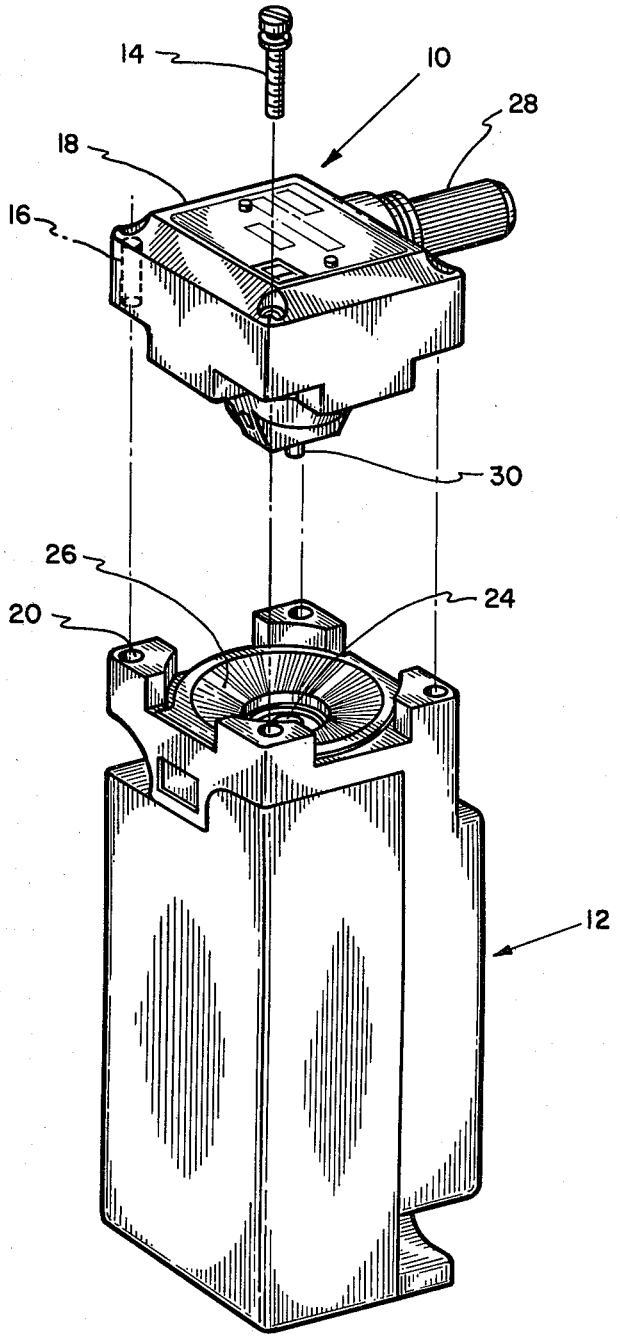
FIG. 1 is a perspective view of the novel electric limit switch.

Whereas the invention may be implemented in various types of electric limit switches, it is preferrably embodied in a switch of the type shown in FIG. 1. The electric limit switch comprises a neutral position lever head 10 and a snap switch 12. The lever head 10 is attached to one end of the snap switch 12 with screws 14. The screws 14 pass through holes 16 in a case 18 of the lever head 10 and are threaded into threaded holes 20 in the end of the snap switch 12 to secure the lever head 10 to the snap switch 12. The end of the snap switch 12 to which the lever head 10 is attached has a raised portion at each corner of the substantially square end. The lower side of the case 18 of the lever head 10 compliments the configuration of the upper end of the snap switch 12, allowing the lever head 10 to occupy any one of four different positions depending on the application in which the limit switch is used.

The snap switch 12 is operated by a stem 24 which is under a constant tension producing an upward force. The construction of the snap switch is well known in the art. A dust and moisture gasket 26 is provided to seal the internal components of the snap switch 12. The stem 24 of the snap switch 12 is located substantially in the center of the end of the snap switch 12 to which the lever head 10 is attached. The snap switch 12 opens and closes internal contacts in three different positions of the stem 24. The depression of the stem 24 to a center location is commonly termed a neutral position.

Figure 2A:
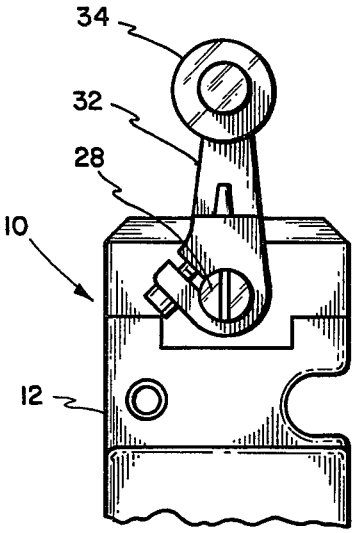
FIG. 2*a*, 2*b* and 2*c* illustrate the neutral, the counterclockwise and the clockwise positions of the lever head of the electric limit switch for operating the snap switch portion.
Figure 2B:
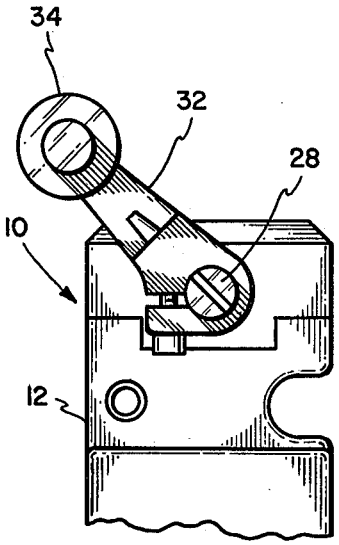
Figure 2C:
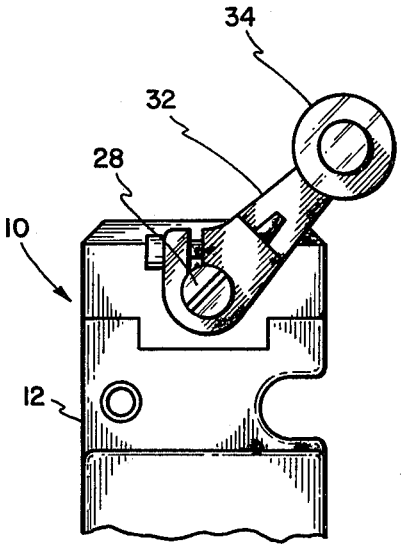

The lever head 10 has a shaft 28 extending exterior of the case 18. Pin 30 of the lever head 10 extends below the lever head 10 and operates the stem 24 of the snap switch 12. When the shaft 28 of the lever head 10 is in a neutral or center position, pin 30 depresses the stem 24 to the neutral position of the snap switch. When the shaft 28 is rotated clockwise, the pin 30 is moved downward causing the stem 24 to move downward to a first position and thereby open and close contacts within the snap switch 12. When the shaft 28 is rotated in a counterclockwise direction, the stem 30 is allowed to move upward thereby allowing the stem 24 to move upward to a second position and opening and closing contacts in the snap switch 12. FIG. 2*a*, 2*b* and 2*c* show the three positions of the shaft 28. In a typical application, one end of an arm 32 is attached to the shaft 28 and the other end of the arm has a wheel position thereon. FIG. 2*a* shows the shaft 28 in a neutral position; FIG. 2*b* shows the shaft 28 in a counterclockwise position; and, FIG. 2*c* shows the shaft 28 in a clockwise position.

In general terms, the present invention is concerned with a multiple position, off center to center movement translator for use with an operator having at least first and second off center movable elements, each having at least one up position and one down position, and for activating a receiver, having a movable member. The movement translator comprises a support cover located between the operator and the receiver. The support cover has first and second sides, the first side facing the operator. The support cover also has a substantially centrally located aperture. The movement translator further comprises a linear actuator extending through the centrally located aperture in the support cover and is in contact with the movable member of the receiver. The movement translator also comprises a tri-lobe roller follower having at least three ball shaped segments, a first end ball segment is in contact with the first movable element, a second center ball segment is in contact with the linear actuator and a third end ball segment is in contact with the second movable element. The tri-lobe roller follower is held in position by a recess in the first side of the support cover. The linear actuator is in a neutral intermediate position when one of the off center movable elements in an up position and the other movable element is in a down position. The linear actuator is in a down position when both of the movable elements are in a down position, and the linear actuator is in an up position when both of the movable elements are in an up position.

The operator is a neutral position limit switch lever head, and the receiver is a snap switch. The lever head comprises a case for attachment to the snap switch, and the case has at least one open side. A shaft is notably mounted on the case, and the axis of the shaft is perpendicular to a stem of the snap switch. First and second cams are mounted on the shaft and are spaced a predetermined distance apart. These cams are the first and second off center movable elements of the operator, or lever head. The support cover of the movement translator is positioned over the open side of the case and is sandwiched between the case and the snap switch. The linear actuator, which extends through the aperture substantially in the center of the support cover, is in contact with the stem of the snap switch. The tri-lobe roller follower is a means for translating the rotation of the cams to a linear movement of the linear actuator. The tri-lobe roller follower is in contact with the first and second cams and also the linear actuator.

Figure 3:
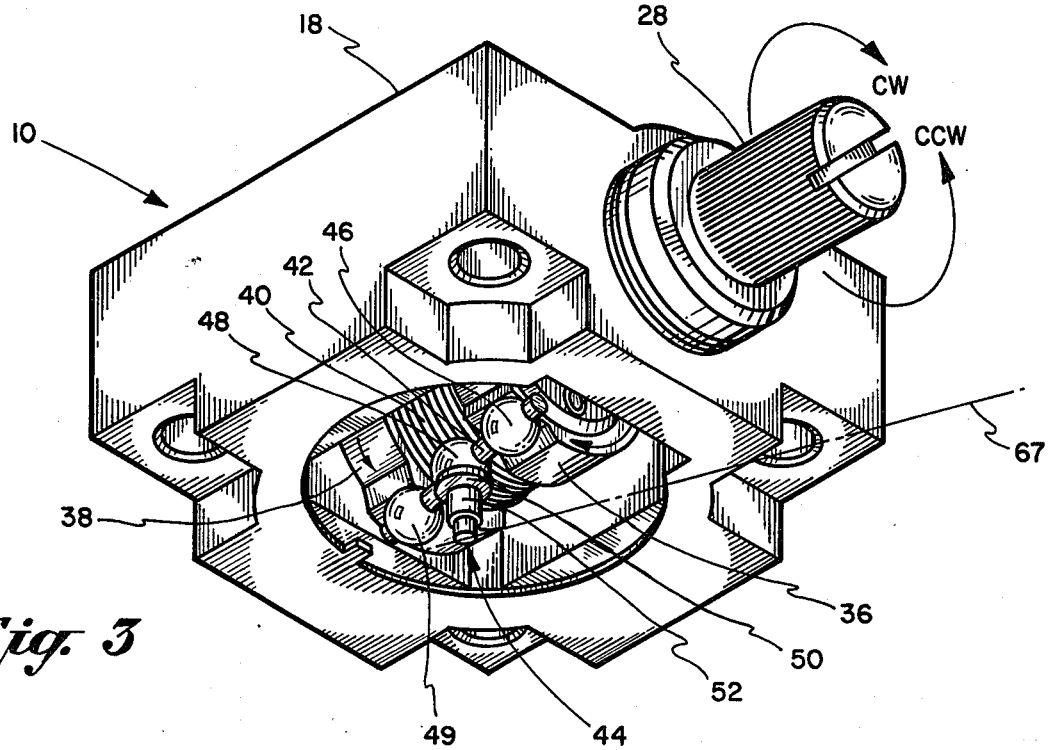
FIG. 3 is a perspective view illustrating the novel movement translator contained within the lever head.
Figure 4A:
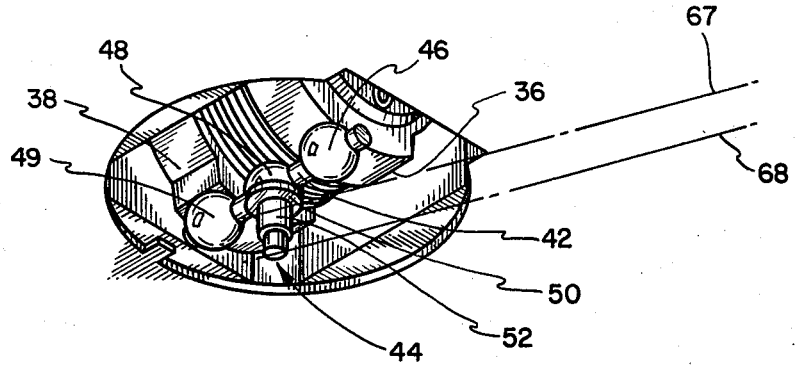
FIG. 4*a* and 4*b* show two positions of the movement translator within the lever head.
Figure 4B:
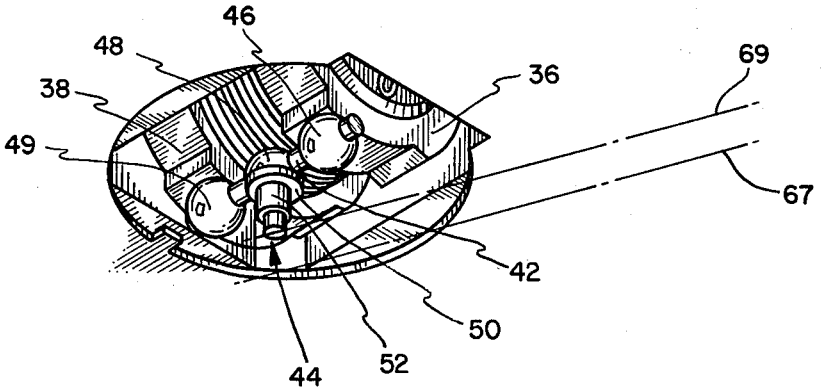

FIGS. 3, 4*a* and 4*b* illustrate a preferred embodiment of the present invention. The shaft 28 is supported by the case 18 of the lever head 10 and may be rotated clockwise or counterclockwise. The shaft 28 occupies a neutral position when no force is applied to the shaft 28. First and second cams 36 and 38 are mounted on the shaft 28 and are spaced a predetermined distance apart. A shaft return torsion spring 40 is positioned on the shaft 28 and is in contact with the first and second cams 36 and 38. As is well known in the art, the shaft return spring 40 and the first and second cams 36 and 38 are structured such that only the first cam 36 rotates when the shaft 28 is turned clockwise, and only the second cam 38 rotates when the shaft 28 is turned counterclockwise. The shaft return spring 40 causes the shaft 28 to return to an intermediate position when no external force is applied to the shaft 28. A tri-lobe roller follower 42 and a pin 44 are provided and comprise part of a novel invention. The tri-lobe roller follower 42 has three ball shaped segments. A first end ball segment 46 is in contact with the first cam 36; a second center ball segment 48 is in contact with a head 50 of the pin 30; and, a third ball end segment 49 is in contact with the second cam 38. FIG. 3 shows the orientation of the tri-lobe roller follower 42 when the shaft 28 is in the neutral position. That is, the first end ball segment 46 is on the lower portion of cam 36, and the third end ball segment 49 is on the upper portion of the second cam 38. This results in the pin 44 having a neutral, or intermediate, position indicated by reference line 67. FIG. 4*a* illustrates that, when the shaft 28 is turned clockwise, the first cam 36 rotates until the first end ball segment 46 is on the upper portion of the first cam 36. This results in the pin 44 moving downward to reference line 68.

Figure 5A:
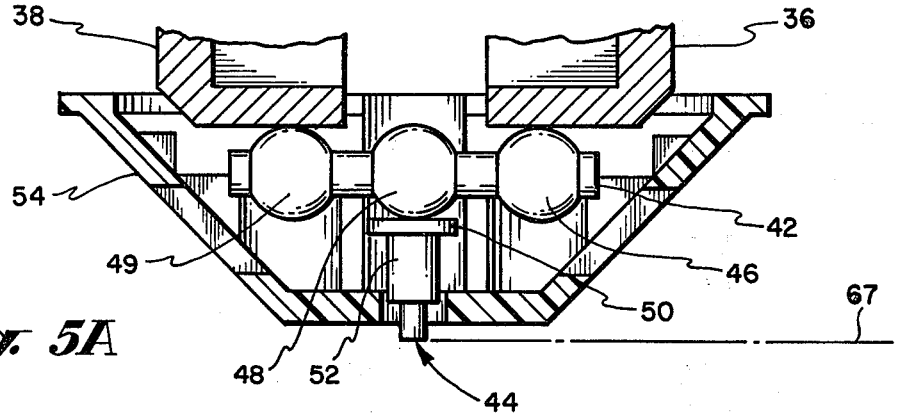
FIG. 5*a*, 5*b* and 5*c* are cut-away schematic diagrams illustrating the various positions of the movement translator within the lever head.
Figure 5B:
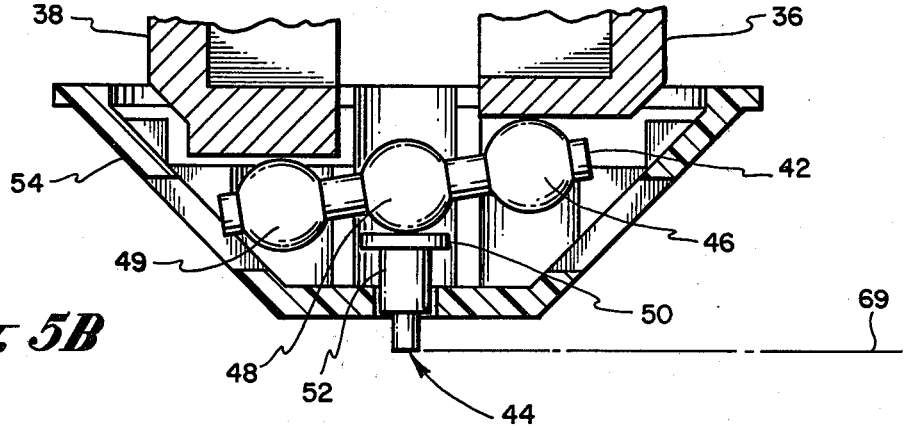
Figure 5C:
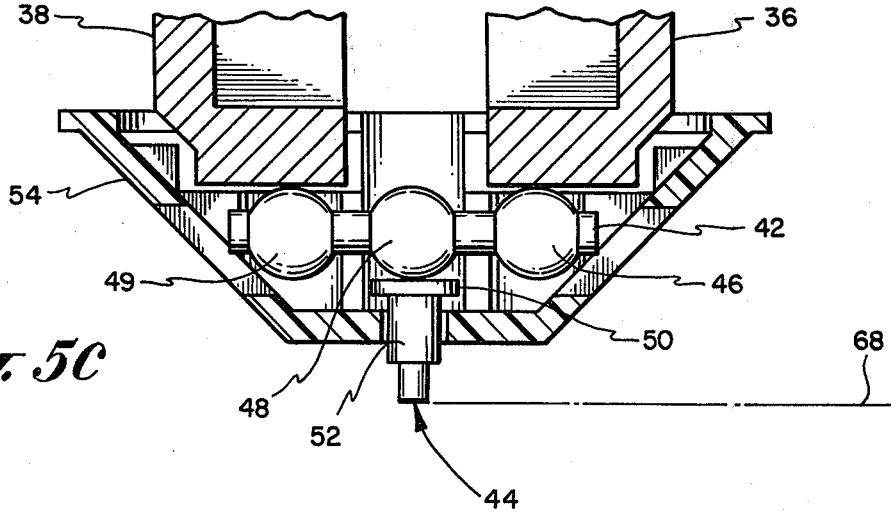

FIG. 4*b* illustrates that, when the shaft 28 is turned counterclockwise, the second cam 38 rotates such that the third end ball segment 49 rests on the lower portion of the second cam 38 allowing the pin 44 to move to an upward position indicated by reference line 69. The sequence of operation is more clearly shown in the cut-away schematic drawings of FIG. 5*a*, 5*b* and 5*c*. In the assembled limit switch, the end of the shaft 52 of the pin 44 opposite the head 50 is in contact with the stem 24 of the snap switch 12. The stem 24 exerts a constant force upon the pin 44 which keeps it in contact with the tri-lobe roller follower 42 which, in turn, keeps the tri-lobe roller follower 42 in contact with the first and second cams 36 and 38.

Figure 6:
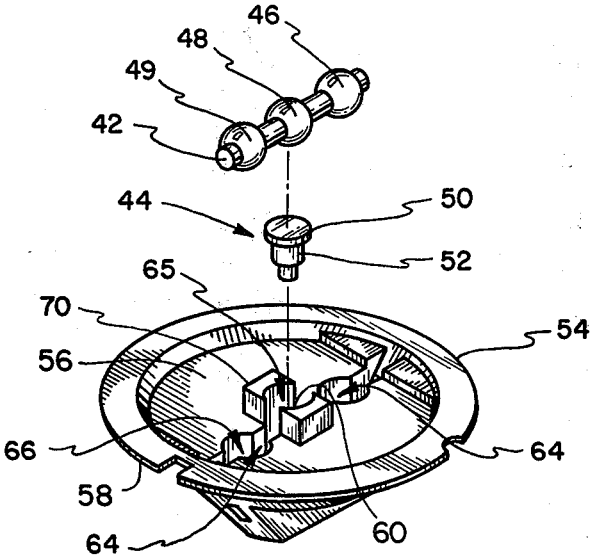
FIG. 6 is a perspective exploded view of the various components comprising the movement translator.
Figure 7:
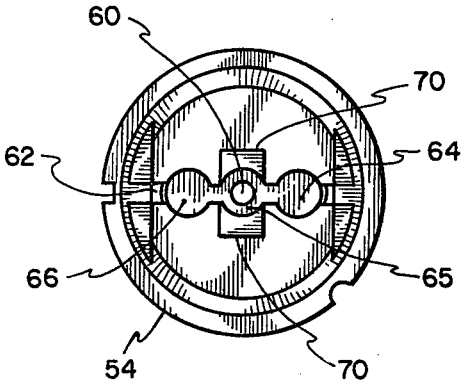
FIG. 7 is a top view of one of the components of the movement translator.

A support cover 54, having first and second sides 56 and 58, is positioned over the open side of the case 18 with the first side 56 facing the case 18. In the assembled limit switch, the support cover 54 is sandwiched between the case 18 and the snap switch 12. The support cover 54 also has a substantially centrally located aperture 60, as shown in FIGS. 6 and 7.

The shaft 52 of the pin 44 extends through the aperture 60 in the support cover 54. The tri-lobe roller follower 42 is held in position by an elongated channel 62 and the first side 56 of the support cover 54. The elongated channel has three enlarged areas 64, 65 and 66 to closely fit the configuration of the tri-lobe roller follower 42. The center enlarged area 65 is positioned directly over the aperture 60 in the center of the support cover 54. The wall-like configuration and positioning of the tri-lobe roller follower 42 allows the follower 42 to move in opposite directions from a neutral position with minimum friction between the follower 42 and the first and second cams 36 and 38 and the pin 44. This novel design allows the rotational movement of the spaced apart first and second cams 36 and 38 to be translated to a linear movement of the linear actuator, or pin 44. A novel device that is simple and reliable in operation. Utilization of the tri-lobe roller follower 42 permits a translation of movement from the two off center movable elements, or cams 36 and 38, to a center located linear movement of the pin 44. This allows the neutral position lever head to be mounted onto the snap switch in any direction without alteration of the components within the neutral position lever head.

In the preferred embodiment, the support cover 54 has an overall diameter of approximately 1.154 inches (2.93 cm), and the aperture 60 in the support cover 54 has a diameter of approximately 0.100 inches (0.254 cm). The elongated channel 62 has a maximum width of approximately 0.165 inches (0.420 cm) and a minimum width of 0.099 inches (0.252 cm). The pin 44 has an overall length of approximately 2.10 inches (5.35 cm), and the diameter of the head 50 is approximately 0.156 inches (0.398 cm). The diameter of the shaft 52 of the pin 44 is approximately 0.093 inches (0.236 cm). The tri-lobe roller follower has an overall length of approximately 0.610 inches (1.55 cm). Each of the three ball segments have a diameter of approximately 0.156 inches (0.398 cm), and the two end ball segments are spaced approximately 0.410 inches (1.04 cm) apart on their centers with the center ball segment being located midway between the two end ball segments. The diameter of the connecting portions between the ball segments are approximately 0.093 inches (0.236 cm). In the preferred embodiment, it was found that providing a small depression in the head 50 of the pin 44 for the center ball segment 48 to ride on improved operation.

Figure 8A:
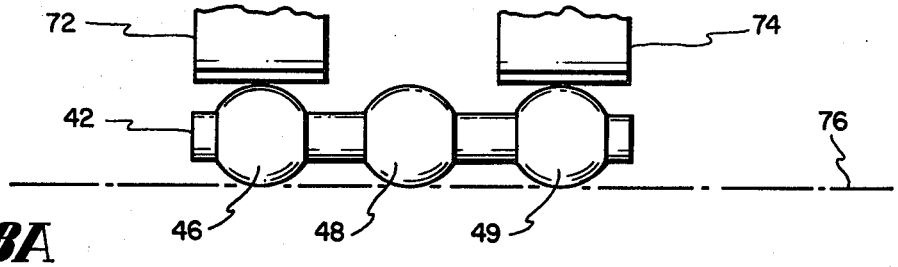
FIG. 8*a*–8*d* schematically illustrate the operation of an alternative embodiment of the present invention.
Figure 8B:
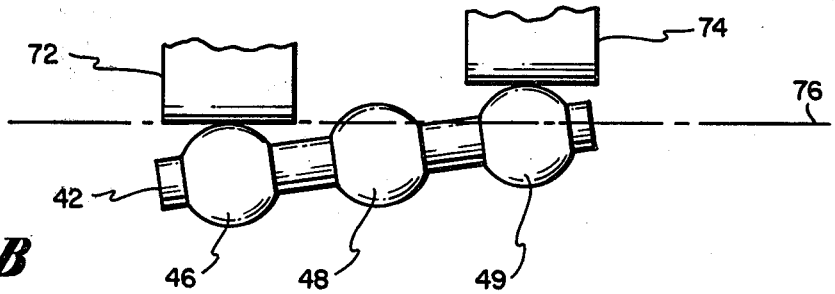
Figure 8C:
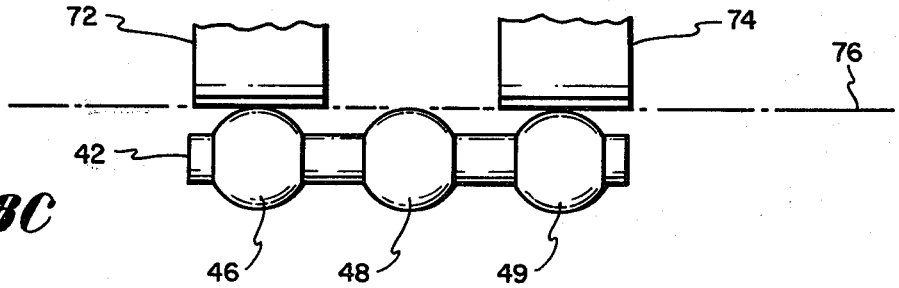
Figure 8D:
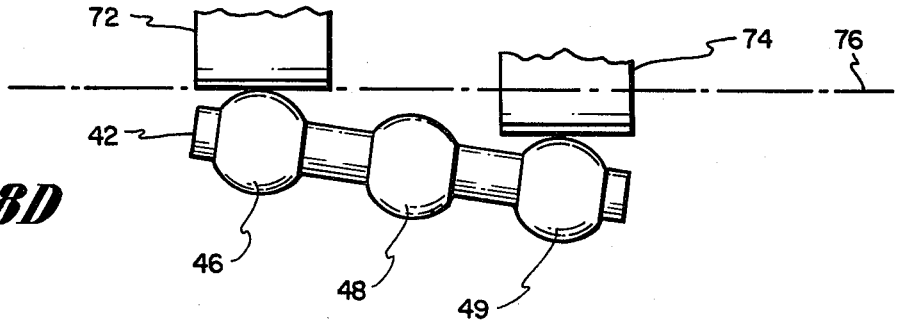

FIGS. 8a–8d illustrate an alternative embodiment of the present invention. In this embodiment, the second center ball segment 48 of the tri-lobe roller follower 42 occupies four different positions. The first movable element 72 has two positions in this embodiment: an up position, as shown in FIG. 8a, and a down position, as shown in FIGS. 8b, 8c and 8d. However, the second movable element 74 has three positions: an up position, as shown in FIGS. 8a and 8b; an intermediate position, as shown in FIG. 8c; and, a down position, as shown in FIG. 8d. It can be seen that the center ball segment 48 occupies four different positions with respect to reference line 76. Therefore, numerous different movements of the tri-lobe roller follower 42 can be effected by the use of different types of movable elements 72 and 74. Numerous other alternative embodiments can be envisioned.

The invention is not limited to the particular details of the apparatus depicted. Other modifications and applications are contemplated. Certain other changes may be made in the above-described apparatus without departing from the true spirit and scope of the invention herein involved. It is intended, therefore, that the subject matter in the above depiction shall be interpreted as illustrative and not in a limiting sense.

What is claimed is:

1. A neutral position limit switch comprising:

an operator having at least first and second off-center movable elements each having at least one up position and one down position;

a snap switch attached to said operator and having a stem for operating said snap switch;

a support cover sandwiched between said operator and said snap switch and having a first side and a second side, said first side facing said operator, said support cover also having a substantially centrally located aperture;

a linear actuator extending through said centrally located aperture in said support cover and in contact with said stem for operating said snap switch; and, a tri-lobe roller follower having three ball shaped segments, a first end ball segment in contact with said first movable element, a second center ball segment in contact with said linear actuator and a third end ball segment in contact with said second movable element, said tri-lobe roller follower being held in position by a recess in said first side of said support cover;

wherein said linear actuator is in a neutral intermediate position when one of said off-center movable elements is in an up position and said other movable element is in a down position, said linear actuator is in a down position when both of said movable elements are in a down position and said linear actuator is in an up position when both of said movable elements are in an up position.

2. The device described in claim 1 wherein said linear actuator is a pin having a shaft extending through said aperture in said support cover and a head contacting said second center ball segment of said tri-lobe roller follower, an end of said shaft opposite said head contacting said stem of said snap switch.

3. The device described in claim 1 wherein said recess in said support cover is an elongated channel having three enlarged areas to closely fit the configuration of said tri-lobe roller follower, said center enlarged area being positioned directly over said aperture in the center of said support cover.

4. A neutral position limit switch lever head for use with a snap switch having a stem for operating the snap switch, said lever head comprising:

a case for attachment to the snap switch, said case having at least one open side;

a shaft notably mounted in said case, said axis of said shaft being perpendicular to said stem of the snap switch;

first and second cams mounted on said shaft and spaced a predetermined distance apart;

a shaft return spring surrounding the shaft and in contact with said first and second cams;

a support cover positioned over said open side of said case and sandwiched between said case and the snap switch;

a linear actuator extending through an aperture substantially in the center of said support cover and in contact with the stem for operating the snap switch; and, a means for translating the movement of said cams to a linear movement of said linear actuator, said translating means including a member having a rounded central portion pivoted on the linear actuator and rounded portions spaced on opposite sides of the rounded central portion and engaged by the first and second cams.

5. The device described in claim 4 wherein said linear actuator is a pin having a shaft extending through said aperture in said support cover and a head engaged by the pivot portion of the translating means for translating the movement of said cams to a linear movement of said linear actuator, an end of said shaft opposite said head contacting the stem of the snap switch.

6. The device described in claim 4 wherein said translating means member is a tri-lobe roller follower having three ball shaped segments, a first end ball segment in contact with said first cam, a second center ball segment in contact with said linear actuator and a third ball end segment in contact with said second cam, said tri-lobe roller follower being held in position by a recess in said support cover.

7. The device described in claim 6 wherein said recess in said support cover is an elongated channel having three enlarged areas to closely fit the configuration of said tri-lobe roller follower, said center enlarged area being positioned directly over said aperture in the center of said support cover.

8. A multiple position off-center to center movement translator for use with an operator having at least first and second off-center movable elements, each having at least one up position and one down position, and for activating a receiver having a movable member, said movement translator comprising:

support cover located between the operator and the receiver, said support cover having first and second sides, said first side facing the operator, said support cover also having a substantially centrally located aperture;

a linear actuator extending through said centrally located aperture in said support cover and in contact with the movable member of the receiver; and, a tri-lobe roller follower having at least three ball shaped segments, a first end ball segment in contact with the first movable element, a second center ball segment in contact with said linear actuator and a thrid end ball segment in contact with the second movable element, said tri-lobe roller follower being held in position by a recess in said first side of said support cover, wherein said linear actuator is in a neutral intermediate position when one of the off-center movable elements is in an up position and the other movable element is in a down position, said linear actuator is in a down position when both of said movable elements are in a down position and said linear actuator is in an up position when both of said movable elements are in an up position.

9. The device described in claim 8 wherein said linear actuator is a pin having a shaft for extending through said aperture in said support cover and a head for contacting said second center ball segment of said tri-lobe roller follower, an end of said shaft opposite said head contacting the movable member of the receiver.

10. The device described in claim 8 wherein said recess in said support cover is an elongated channel having three enlarged areas to closely fit the configuration of said tri-lobe roller follower, said center enlarged area being positioned directly over said aperture in the center of said support cover.

11. A multiple position off-center to center movement translator for use with an operator having at least first and second off-center movable elements each having at least one up position and one down position and for activating a receiver having a movable member, said movement translator comprising:

a support cover located between the operator and the receiver, said support cover having first and second sides, said first side facing said operator, said support cover also having a substantially centrally located aperture;

a pin having a shaft extending through said centrally located aperture in said support cover, one end of said shaft in contact with the movable member of the receiver, the other end of said shaft having a head; and, a tri-lobe roller follower having at least three ball shaped segments, a first end ball segment in contact with the first movable element, a second center ball segment in contact with said head of said pin and a third end ball segment in contact with the second movable element, said tri-lobe roller follower being held in position by an elongated channel in said first side of said support cover, said elongated channel having three enlarged areas to closely fit the configuration of the tri-lobe roller follower, said center enlarged area being positioned directly over said aperture in the center of said support cover;

wherein said pin is in a neutral intermediate position when one of the off-center movable elements is in an up position and the other movable element is in a down position, said pin is in a down position when both of the movable elements are in a down position and said pin is an in up position when both of the movable elements are in an up position.

12. A neutral position limit switch lever head for use with a snap switch having a stem for operating the snap switch, said lever head comprising:

a case for attachment to the snap switch, said case having at least one open side;

a shaft pivotally attached to said case, said axis of said shaft being perpendicular to the stem of the snap switch;

first and second cams attached to said shaft and spaced a predetermined distance apart;

a shaft return spring attached to said shaft and in contact with said first and second cams, such that only said first cam rotates when said shaft is turned clockwise and only said second cam rotates when said shaft is turned counterclockwise, said shaft return spring causing said shaft to return to an intermediate position when no external force is applied to said shaft;

a support cover having first and second sides and positioned over said open side of said case, said first side facing said case, said support cover being sandwiched between said case and the snap switch, said support cover also having a substantially centrally located aperture;

a pin having a shaft extending through said aperture in the center of said support cover, one end of said shaft in contact with the stem for operating the snap switch, and the other end of said shaft having a head; and, a tri-lobe roller follower having three ball shaped segments, a first end ball segment in contact with said first cam, a second center ball segment in contact with said head of said pin and a third ball end segment in contact with said second cam, said tri-lobe roller follower being held in position by an elongated channel in said first side of said support cover, said elongated channel having three enlarged areas to closely fit the configuration of said tri-lobe roller follower, said center enlarged area being positioned directly over said aperture in the center of said support cover;

wherein said pin is in a neutral intermediate position when one of said two cams is in a down position and said other cam is in an up position, said pin is in a down position when both of said cams are in a down position, and said pin is in an up position when both of said cams are in an up position.

* * * * *